US006847195B2

(12) United States Patent
Chen

(10) Patent No.: US 6,847,195 B2
(45) Date of Patent: Jan. 25, 2005

(54) AUXILIARY CIRCUIT FOR POWER FACTOR CORRECTOR HAVING SELF-POWER SUPPLYING AND ZERO CURRENT DETECTION MECHANISMS

(75) Inventor: Ching-Chuan Chen, Taipei (TW)

(73) Assignee: Skynet Electronic Co., Ltd., Taipei (TW)

( * ) Notice: Subject to any disclaimer, the term of this patent is extended or adjusted under 35 U.S.C. 154(b) by 207 days.

(21) Appl. No.: 10/212,694

(22) Filed: Aug. 7, 2002

(65) Prior Publication Data

US 2004/0027096 A1 Feb. 12, 2004

(51) Int. Cl.[7] ..... G05F 1/652
(52) U.S. Cl. ..... 323/222; 323/282; 323/285
(58) Field of Search ..... 363/89; 323/222, 323/282, 283, 284, 285

(56) References Cited

U.S. PATENT DOCUMENTS 5,359,281 A * 10/1994 Barrow et al. ..... 323/284
5,818,707 A * 10/1998 Seong et al. ..... 363/89

* cited by examiner

*Primary Examiner*—Gary L. Laxton
(74) *Attorney, Agent, or Firm*—Bacon & Thomas, PLLC

(57) ABSTRACT

The invention is to provide an auxiliary circuit for power factor corrector (PFC) having self-power supplying and zero current detection (ZCD) mechanisms, which comprises a filter capacitor electrically coupled to a secondary winding of an inductor of the auxiliary circuit installed in a power supply and two resistors respectively coupled the positive and negative terminals of the filter capacitor in series with a ZCD pin of a PFC. Such that the secondary winding can be shared by the ZCD and the power supply pins of the PFC to eliminate a necessity of providing an additional ZCD winding and reduce the complexity of circuitry, the manufacturing cost, and a size of power supply without sacrificing power.

4 Claims, 11 Drawing Sheets

AUXILIARY CIRCUIT FOR POWER FACTOR CORRECTOR HAVING SELF-POWER SUPPLYING AND ZERO CURRENT DETECTION MECHANISMS

FIELD OF THE INVENTION

The present invention relates to power supplies and more particularly to an auxiliary circuit for power factor corrector having self-power supplying and zero current detection mechanisms.

BACKGROUND OF THE INVENTION

Conventionally, power factor (PF) is not considered in designing circuitry by almost all circuit designers. However, as to the design of power supply, since the input current thereof typically is a non-sinusoidal wave, in order to obtain a direct current (DC) voltage from an alternating current (AC) input end of the power supply, a bridge rectifier in parallel with a input filtering capacitor are typically provided in designing the power supply for converting and filtering an alternating current (AC) input. A charging on the input filtering capacitor occurs only when voltage of the input current exceeds a voltage across two terminals of the input filtering capacitor. In the conventional power supply, for reducing ripple factor, a capacitance of the input filtering capacitor is necessary to be designed as large as possible, which eventually causes the voltage of the AC input lower than that of the capacitor in most time. In other words, the bridge rectifier is conducted only in a short period of time of a half-cycle. As a result, a peak of the obtained waveform is several times larger than that of the equivalent root-means-square (rms). An undesired distortion of the power source is occurred due to an equivalent inductance as the very high instantaneous peak current flows through windings of the power supply. The distortion can increase a load of the power source. This is so-called power pollution. Theoretically, magnitude of the power pollution is expressed in terms of harmonic component or PF.

In fact, PF consists of current distortion and phase-shift parameters wherein the later can be compensated in the power source side. But the former has to be corrected in the side being used. For example, a load having a rated 15 A is electrically connected to a 15 A power socket of an AC power socket assembly having a nominal rating of 115V and 15 A. In a case that a power supply (having a PF of about 0.6) electrically coupled to the load does not have a power factor correction (P.F.C.) mechanism an effective input current as outputted from the power supply will only be 9 A not the desired 15 A. In view of the above, in a case that, in a normal operation, four computers all having P.F.C. circuits are electrically connected to the AC power socket assembly, there is no way to guarantee that two computers without built-in P.F.C. circuits can operate normally.

The power pollution caused by the distortion not only reduces an efficiency of power network thus causing difficulties of power control to a power company but also forces the power company to use thicker lines for power transmission. In this regard, recently many European countries set out a number of rules such as EN61000-3-2 for limiting a ripple current generated by power equipment and requiring all lights and electrical appliances having large power to be equipped with P.F.C. circuits prior to being permitted to import to Europe. Such rules must have a certain degree of impact on Taiwan since Taiwan is an export-oriented economy with household appliances and information products being the most important export items. Thus, it is important for manufacturers to install P.F.C. circuits in household appliances, computers, monitors, and power supplies prior to exporting the same to European countries since the P.F.C. circuit can effectively eliminate the undesired effect caused by ripple current.

In recent years, for complying with the current limitation of EN61000-3-2 many power supply manufacturers install power factor correctors (PFCs) in their switch-based power supply products. The PFCs may be classified as either passive ones or active ones. Booster type PFCs are the most widely used ones of active PFCs. Such booster type PFCs are further classified as either continuous conduction mode (CCM) ones having a fixed frequency or boundary mode ones having a variable frequency. A CCM controller is featured by a smaller peak current flowed through a switch, i.e., lower conduction loss. However, it has a larger switching loss and a poor EMI. Such CCM controller can be found in an IC having a Serial No. UC3854 available from Unitrode Inc. The IC has 16 pins and is complicated in applications. In contrast, a variable frequency-based controller is featured by a zero switching current, i.e., lower switching loss. However, it has a larger conduction loss and a higher peak current passed through the switch. Such variable frequency-based controller can be found in an IC having a Serial No. L6561 available from SGS Thomson Inc. or an IC having a Serial No. MC33262 available from Motorola Inc. Either IC has 8 pins and is simple in applications. It is important to note that the $R_{Dson}$ parameter should be taken a particular interest in selecting a switch since the lower of value of the $R_{DSon}$ parameter the lower the switching loss.

In general, operation principle of a switch-based power supply is as follows: Stored energy is adjusted by adjusting a duty cycle of a switch, thereby outputting power. As such, the active PFC is featured that an input energy is adapted to output requirements during the duty cycle of switch adjustment and a shape of input current is adapted to be similar to the sinusoidal wave of AC power source. It is known that an electronic switch is activated only when current is zero under the PFC operating condition. Hence, a built-in zero current detector (ZCD) is required. This is best illustrated in a circuit diagram of a well known power supply 10 of FIG. 1. The power supply 10 has an incorporated PFC 20. A waveform of the power supply 10 is shown in FIG. 2. An operation principle of the power supply 10 is as follows: When a discharge current of an inductor 30 of a booster type switch is dropped to zero the stored inductance and stray capacitance will generate a harmonic. Voltage Vns of a secondary winding 31 of the inductor 30 will have a negative-edge waveform from high to low. Referring to FIG. 1 again, an example of the PFC 20 formed of the ICs having Serial No. L6561 available from SGS Thomson Inc. will now be described. When a ZCD pin ZCD detects that voltage $V_{ZCD}$ has dropped below a critical voltage Vth a comparator in the PFC formed of the ICs having Serial No. L6561 will be triggered to generate a control signal for conducting the MOSFET switch 40. This is the mechanism of zero starting current. The detected voltage at pin ZCD must be larger than the critical voltage Vth before a next conduction in order to reset the PFC 20. Thus, a winding ratio n of the inductor winding relative to a winding coupled to ZCD pin ZCD (called ZCD winding in the invention) must satisfy the following equation (1):

$$n \leq \frac{V_0 - V_{in,rms}(\max)}{Vth} \quad (1)$$

In a case that the power supply has a rated input voltage Vin in a range of 90V to 264V and a rated output voltage Vo of 400V the ratio of ZCD winding must be lower than 12.7:1. In a case that a ratio of the secondary winding 31 is 20:1 as designed the input voltage Vin will be 264V, resulting in abnormal discontinuous duty cycles of a control circuit. This is because when the input voltage Vin is equal to a peak Vipk, the voltage $V_{ZCD}$ at the ZCD pin does not exceed the critical voltage Vth. As a result, the reset is disabled. The abnormal operation can be best illustrated by referring to the waveform of FIG. 3. As such, typically the secondary winding 31 must be reconfigured to comprise a ZCD winding 311 for current detection and a power supply winding 312 for supplying power as shown in FIG. 4(*a*). This not only increases a complexity of circuitry and manufacturing cost but also increases a size of the power supply. Moreover, one solution proposed by a manufacturer is that the single secondary winding 31 is shared by the ZCD pin ZCD and the power supply pin Vcc of the PFC 20. As such, the ratio of the secondary winding 31 is designed to comply with the requirements of the ZCD pin ZCD. Further, the secondary winding 31 is directly coupled to the ZCD pin ZCD. However, voltage of the secondary winding 31 after being rectified by the capacitor filter will exceed a required voltage at the pin Vcc of the PFC 20. Thus, an additional linear voltage stabilization circuit 32 is incorporated in the power supply 10 for lowering voltage as shown in FIG. 4(*b*). As a result, a reduced voltage of power supply is obtained. Unfortunately, such technique cannot reduce the complexity of circuitry and the manufacturing cost. Thus improvement exists.

SUMMARY OF THE INVENTION

The invention relates to an auxiliary circuit for power factor corrector (PFC) having self-power supplying and zero current detection (ZCD) mechanisms for overcoming the above drawback of the prior art, i.e., the ZCD winding and the power supply winding in the PFC of the switch-based power supply cannot be combined as one. The auxiliary circuit of the invention is provided in a switch-based power supply. A filter capacitor is electrically coupled to a secondary winding of an inductor of the auxiliary circuit. Positive and negative terminals of the filter capacitor are in series with a ZCD pin of a PFC via respective resistors. The secondary winding is shared by a power supply pin of the PFC via a power supply circuit.

A primary object of the present invention is that the secondary winding can be shared by the ZCD and the power supply pins of the PFC, thus eliminating a necessity of providing an additional ZCD winding. By utilizing the invention, it is possible of further reducing the complexity of circuitry, the manufacturing cost, and a size of power supply without sacrificing power.

Another object of the present invention is that the secondary winding can be shared by the ZCD and the power supply pins of the PFC without being limited by a ratio of winding, thereby significantly increasing a stability of a control circuit.

The above and other objects, features and advantages of the present invention will become apparent from the following detailed description taken with the accompanying drawings.

BRIEF DESCRIPTION OF THE DRAWINGS

FIG. 4(*b*) is a circuit diagram of a control circuit showing the control circuit of FIG. 1 reconfigured as a single secondary winding;

DETAILED DESCRIPTION OF THE PREFERRED EMBODIMENTS

It is known that there are many specifications of control circuits of PFCs incorporated in a conventional switch-based power supply. In the invention, for the purpose of illustrating a design scheme, implementations, and an effect of the invention, a PFC formed of the ICs having Serial No. L6561 available from SGS Thomson Inc. will be taken as a preferred embodiment, while it is appreciated by those skilled in the art that such PFC may be implemented by another suitable device without departing from the scope and spirit of the invention. It is known that the ICs having Serial No. L6561 available from SGS Thomson Inc. are particularly suitable for small power applications. As such, the PFC formed of the ICs having Serial No. L6561 available from SGS Thomson Inc. only has 8 pins having an operating power in a range of 100 W to 500 W. The design and applications of the PFC are advantageous for simplicity and convenience. Also, the PFC itself is required to operate in a critical current mode. Within the PFC, there are provided an over-voltage protection circuit, a low starting current circuit, an operating current stability circuit, and a starting oscillator for generating a gate driving signal when the PFC is being activated.

Figure 1:
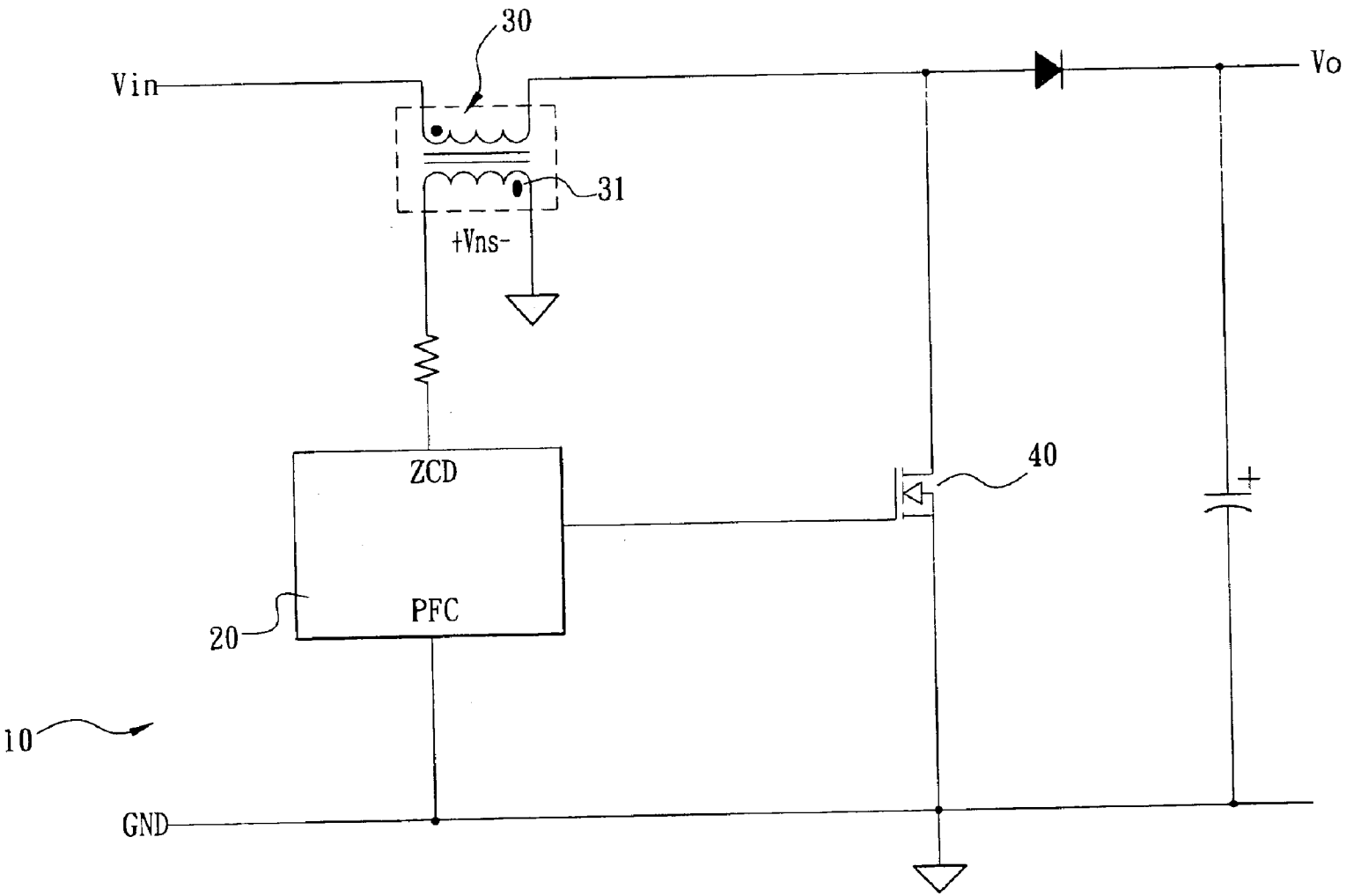
FIG. 1 (Prior Art)
FIG. 1 is a circuit diagram of a control circuit of a conventional switch-based power supply incorporating a PFC.
Figure 2:
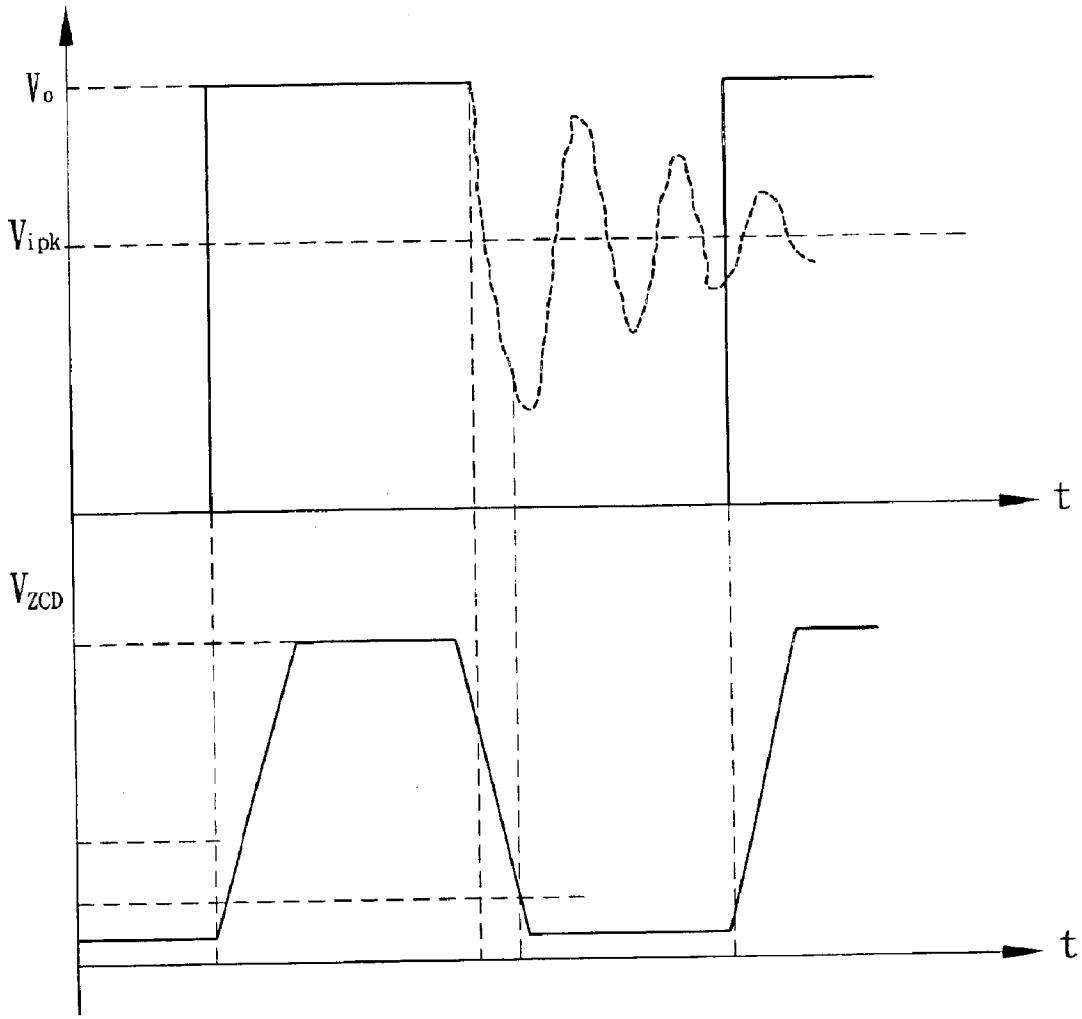
FIG. 2 (Prior Art)
FIG. 2 is a waveform of voltage $V_{ZCD}$ detected at ZCD pin ZCD, input voltage Vin, and output voltage Vo versus time of the control circuit of FIG. 1.
Figure 3:
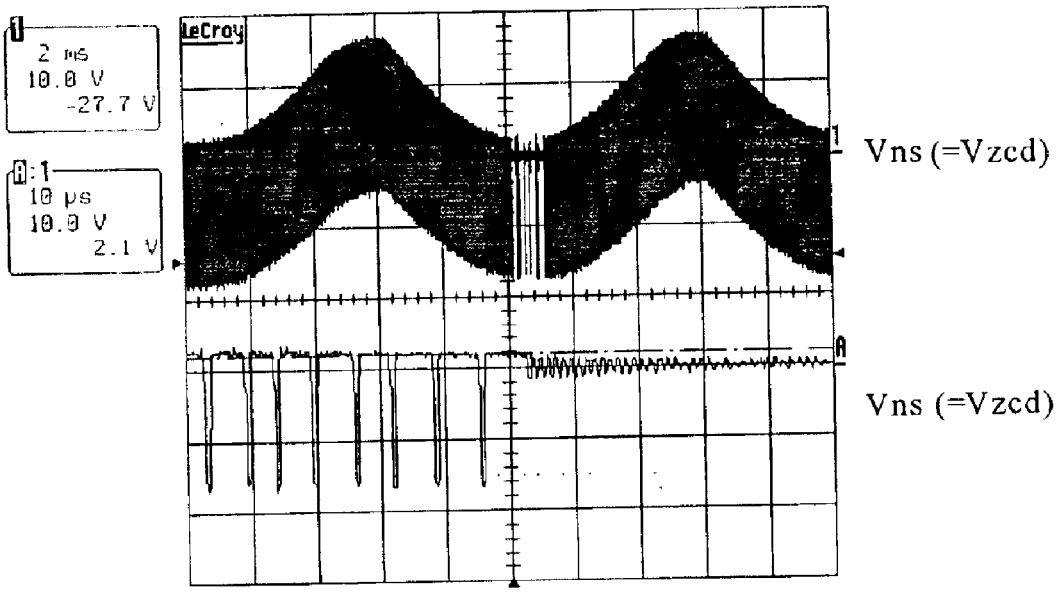
FIG. 3 (Prior Art)
FIG. 3 is a waveform of voltage $V_{ZCD}$ detected at ZCD pin ZCD as the input voltage is equal to peak Vipk in the control circuit of FIG. 1.
Figure 4A:
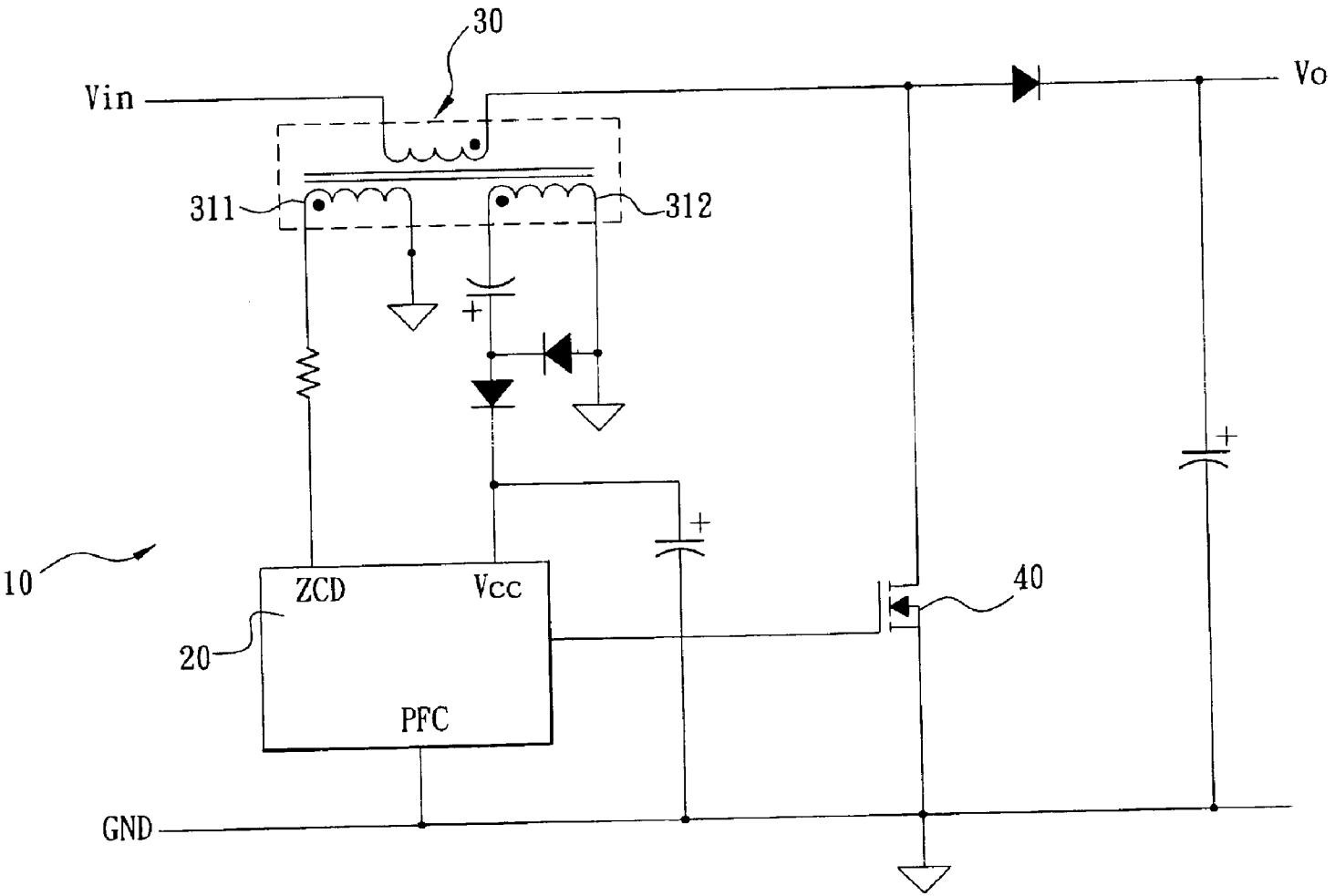
FIG. 4(a) (Prior Art)
FIG. 4(*a*) is a circuit diagram of a control circuit showing the secondary winding of the control circuit of FIG. 1 reconfigured to comprise a ZCD winding and a power supply winding.
Figure 4B:
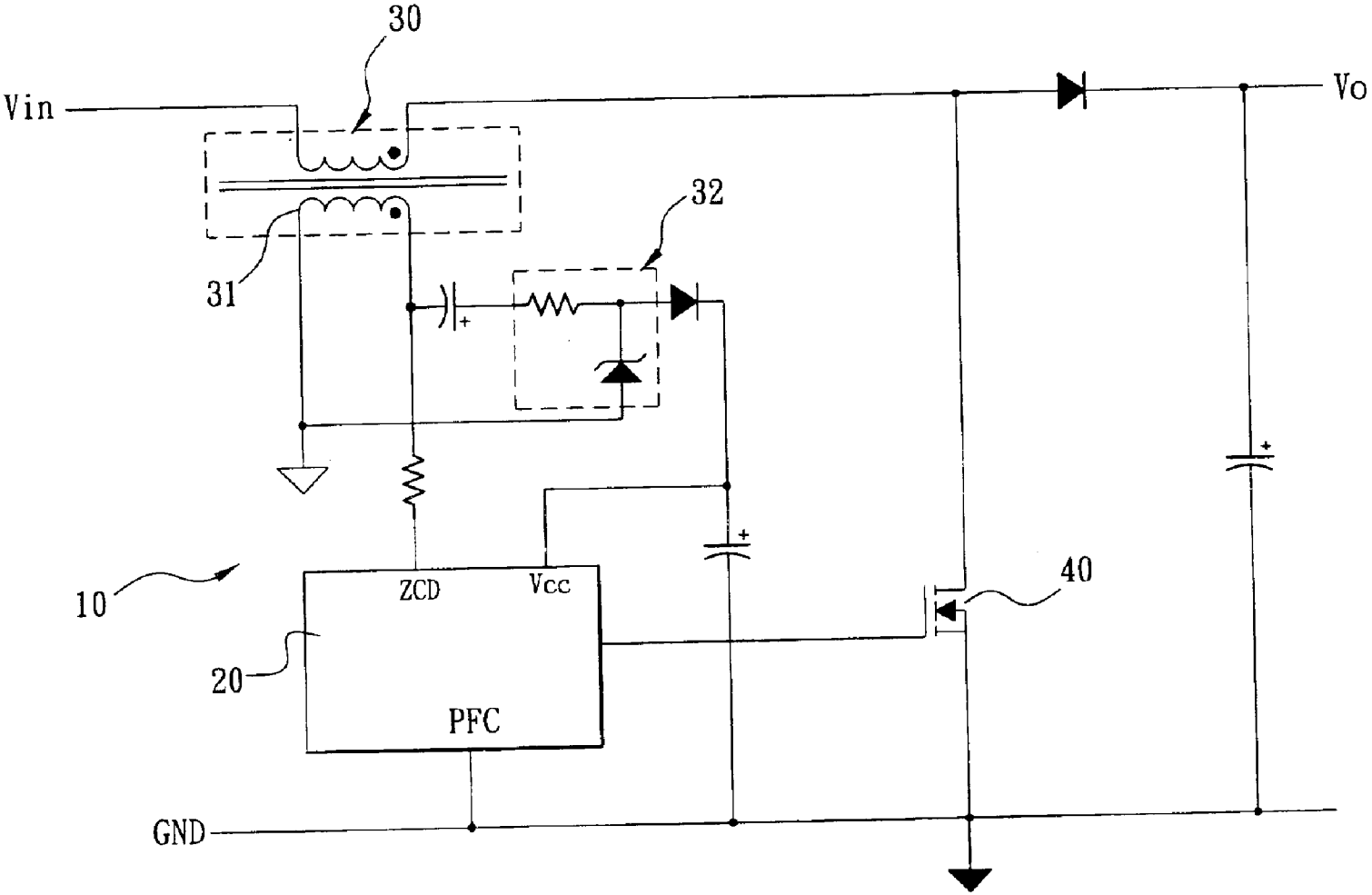
FIG. 4(b) (Prior Art)
Figure 5:
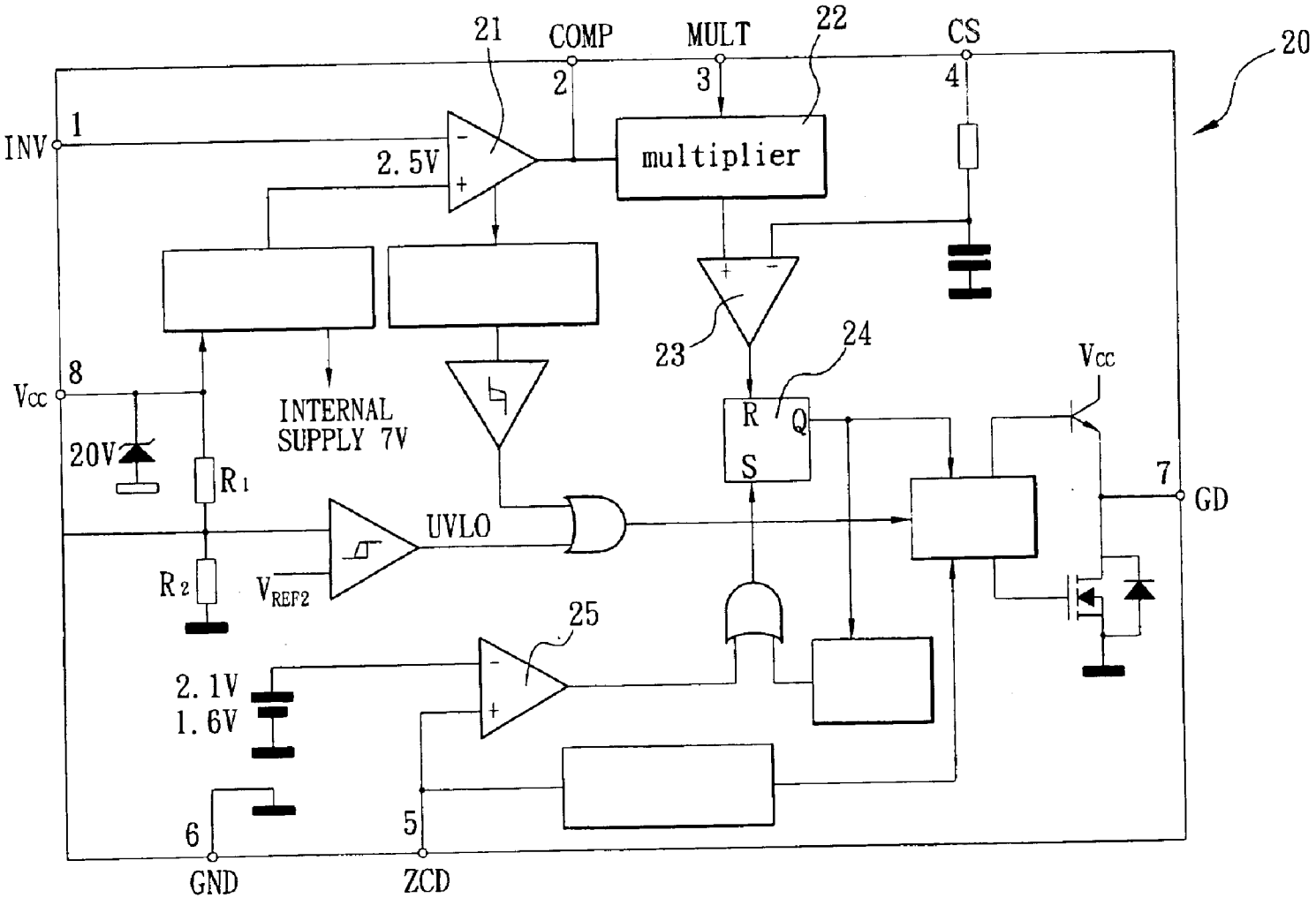
FIG. 5 is a circuit diagram of a PFC formed of the ICs having Serial No. L6561 available from SGS Thomson Inc.

Referring to FIG. 5, the FPC 20 is incorporated in a switch-based power supply in the invention. A first pin of the PFC 20 is coupled to a voltage component INV of a booster type converter. The voltage INV is further inputted to an internal error amplifier (E/A) 21. The E/A 21 is subtracted by an internal DC reference signal prior to being filtered. An error signal is generated after filtering. A bandwidth of the error signal is much lower than that of a power rectification signal as designed. Also, the bandwidth of the error signal may be viewed as DC in a cycle of a power source with respect to its fluctuation. Next, a multiplier 22 of the PFC 20 performs a multiplication of the error signal and a power rectification signal MULT at a third pin received from a bridge rectifier. The multiplication product is served as a reference signal for an inductor current peak. A comparator 23 of the PFC 20 performs a comparison of the reference signal with an inductor current CS detected at a fourth pin of the PFC 20. If a peak of the inductor current CS has reached the reference signal a pulse will be outputted from the comparator 23 to an RS latch 24 for closing the same.

Figure 6:
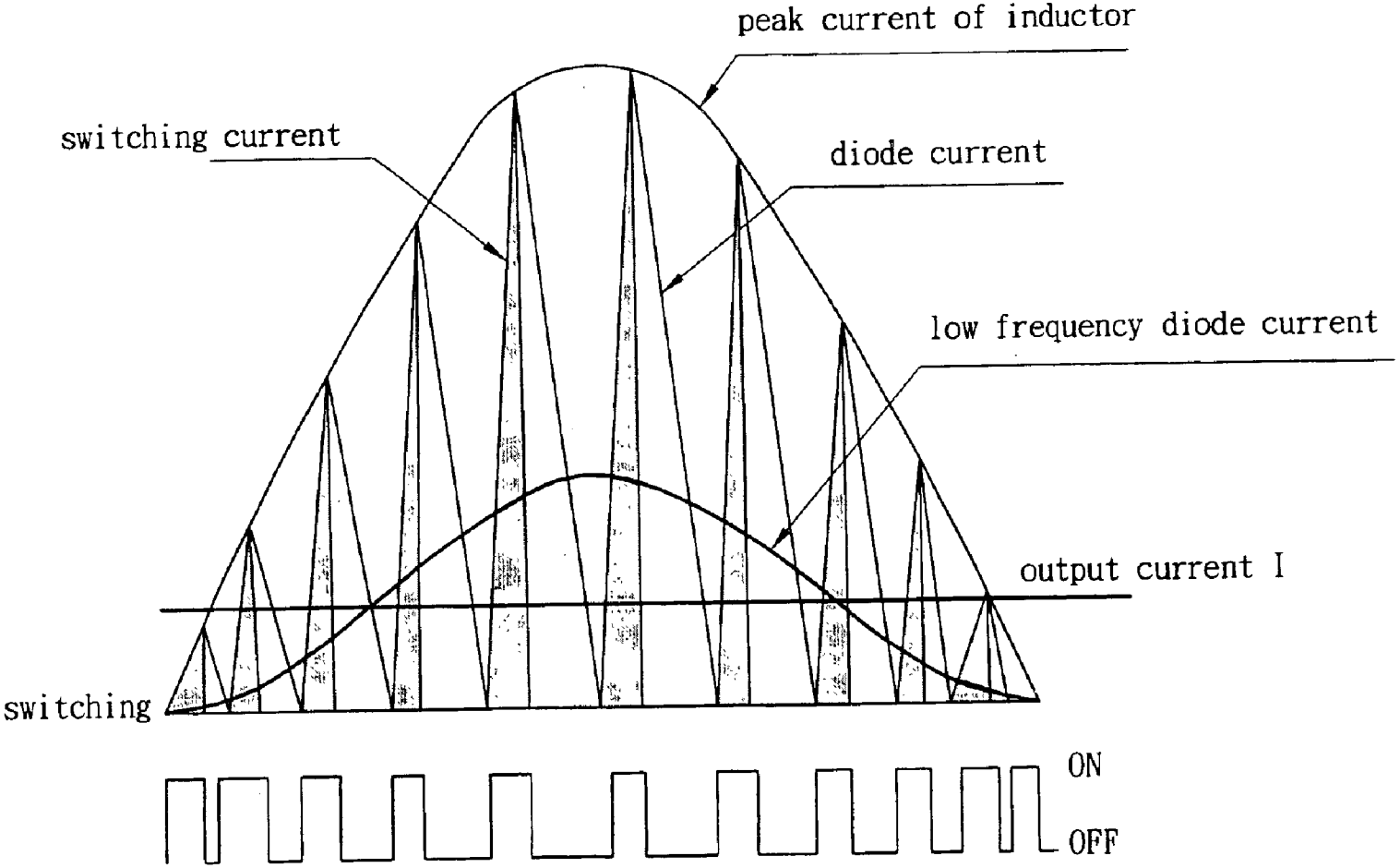
FIG. 6 is waveform of current of an inductor under a boundary mode having a variable frequency according to the invention.

In response to the closing of the RS latch 24, the inductor current begins to drop linearly until a ZCD pin ZCD of the PFC 20 detects a zero current signal. That is, a PFC element 25 of the PFC 20 will output a pulse to the RS latch 24 for conducting again in response to the detection of zero value of the inductor current. At this time, a power source can be viewed to have a fixed value during any one cycle if it is assumed that a switching frequency is much higher than a power source frequency. Also, the inductor current will increase linearly. This completes a switching of one cycle. In view of a control result, the PFC 20 may obviously cause a control circuit of the booster type converter to operate in at a boundary of a variable frequency boundary mode (i.e., continuous conduction mode (CCM)) and a discontinuous conduction mode (DCM). Referring to FIG. 6, an average current of each cycle is about one half of a peak current of the cycle in the control circuit of the booster type converter in the variable frequency boundary mode. Also, a reference signal of a peak current $I_{LPK}$ is a multiplication product of the power rectification signal and a DC error signal. Hence, a waveform of the reference signal of the peak current $I_{LPK}$ is the same as that of the power rectification signal. Further, an average waveform of the inductor current will be very close to that of the power rectification signal. As a result, a purpose of correcting power factor is achieved.

Figure 7:
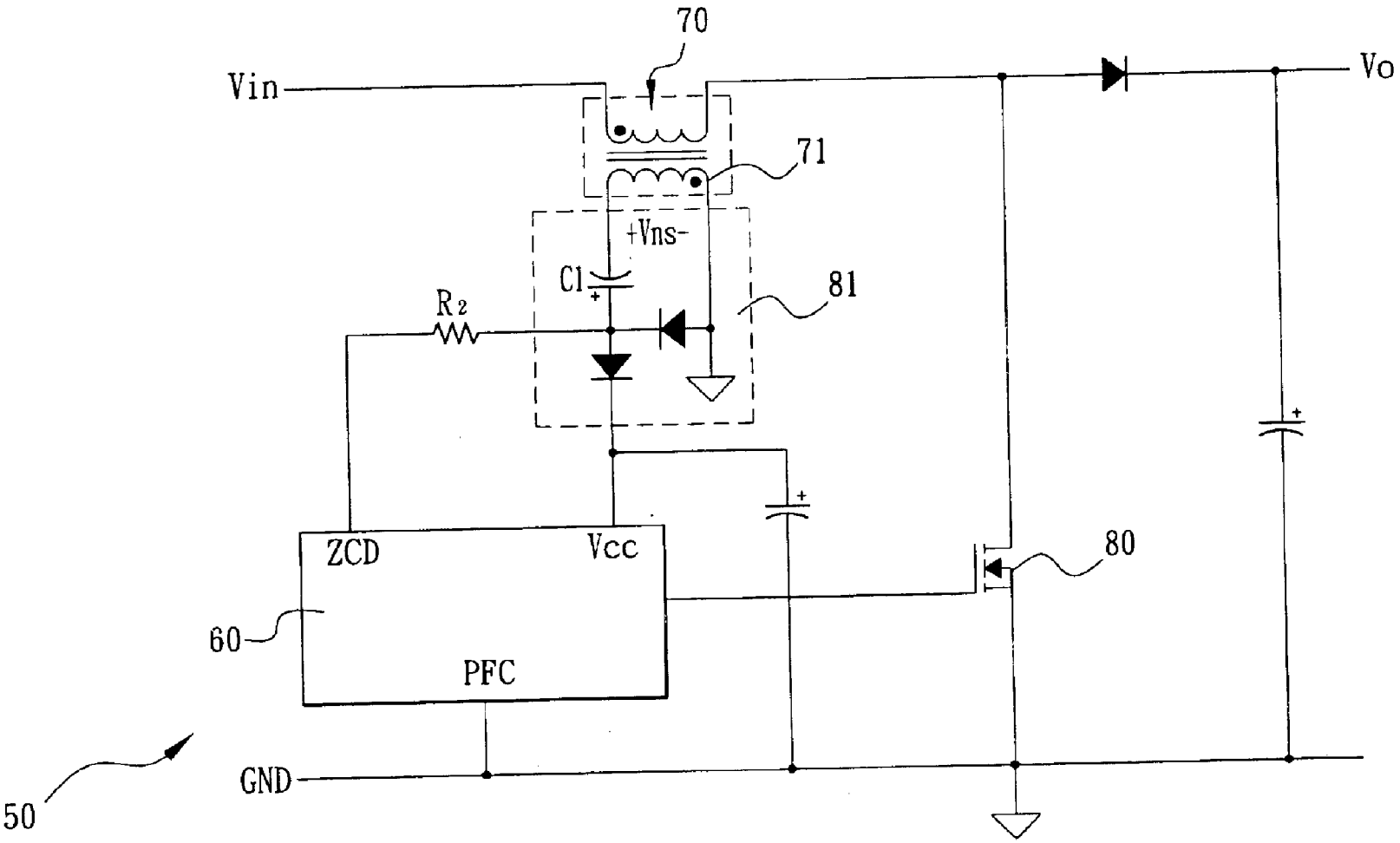
FIG. 7 is a circuit diagram of a control circuit of the invention incorporating a resistor $R_2$.
Figure 8:
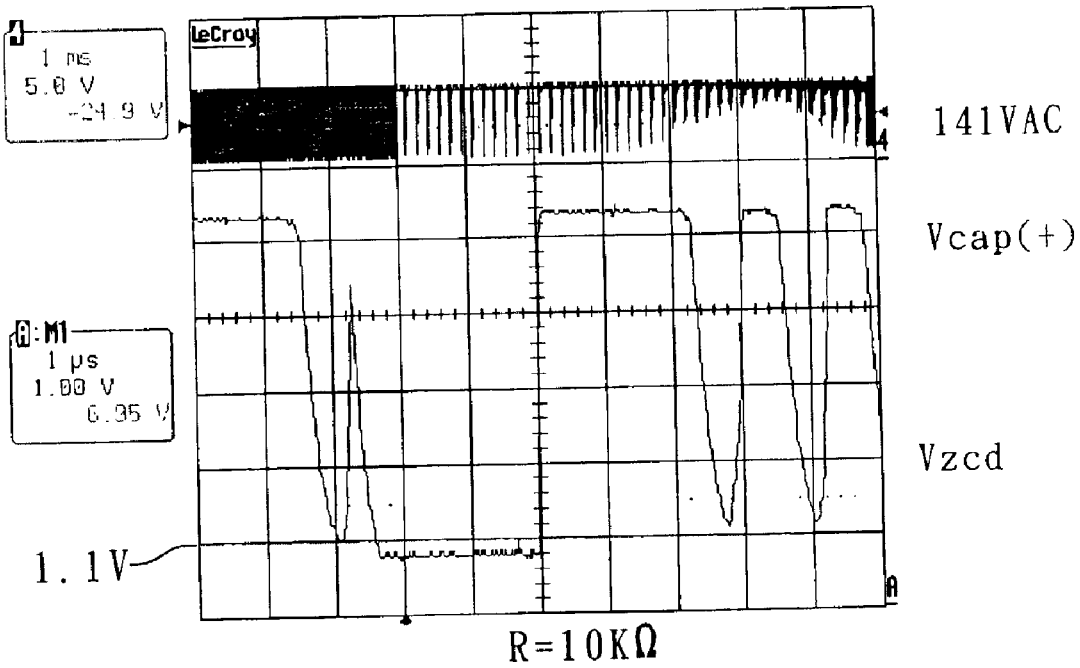
FIG. 8 is a waveform of voltage detected at ZCD pin ZCD as the input voltage is high in the control circuit of FIG. 7.

In the invention it is desirable to configure the PFC incorporated in the switch-based power supply to share the same winding (i.e., a secondary winding) in order to obtain a ZCD signal and a power supply. As such, a PFC 60 formed of the ICs having Serial No. L6561 available from SGS Thomson Inc. is provided in a switch-based power supply 50 as shown in FIG. 7. Pins of the PFC 60 are coupled to control lines of the switch-based power supply 50 respectively depending on applications. Thus, it is possible of achieving the purpose of correcting power factor in the converter of the PFC 60. In the invention, voltage of a secondary winding 71 of an inductor 70 in the converter has an amplitude of rated 60 HZ. Hence, a ratio of the secondary winding 71 must comply with the limitation of the above equation (1). This is because a positive terminal Vcap(+) of a rectification filter capacitor C1 of a power supply circuit 81 for supplying power does not contain the amplitude of rated 60 HZ as referring to FIGS. 5 and 7 again. A configuration is effected by connecting a resistor $R_2$ in series with the positive terminal Vcap(+) of the rectification filter capacitor C1 which is in turn coupled to the ZCD pin ZCD of the PFC 60. This can eliminate the undesirable effect of the amplitude of rated 60 HZ. However, a dropping negative-edge voltage $V_{ZCD}$ at the ZCD pin ZCD cannot drop below 1.6V when the input voltage Vin is high as shown in FIG. 8. Thus, the PFC element 25 in the PFC 60 cannot be triggered. As a result, a control signal for conducting a MOSFET switch 80 is prohibited from generating. In view of the above, the configuration of a series connection of the positive terminal Vcap(+) of the rectification filter capacitor C1, the resistor $R_2$, and the ZCD pin ZCD of the PFC 60 is not practical.

Figure 9:
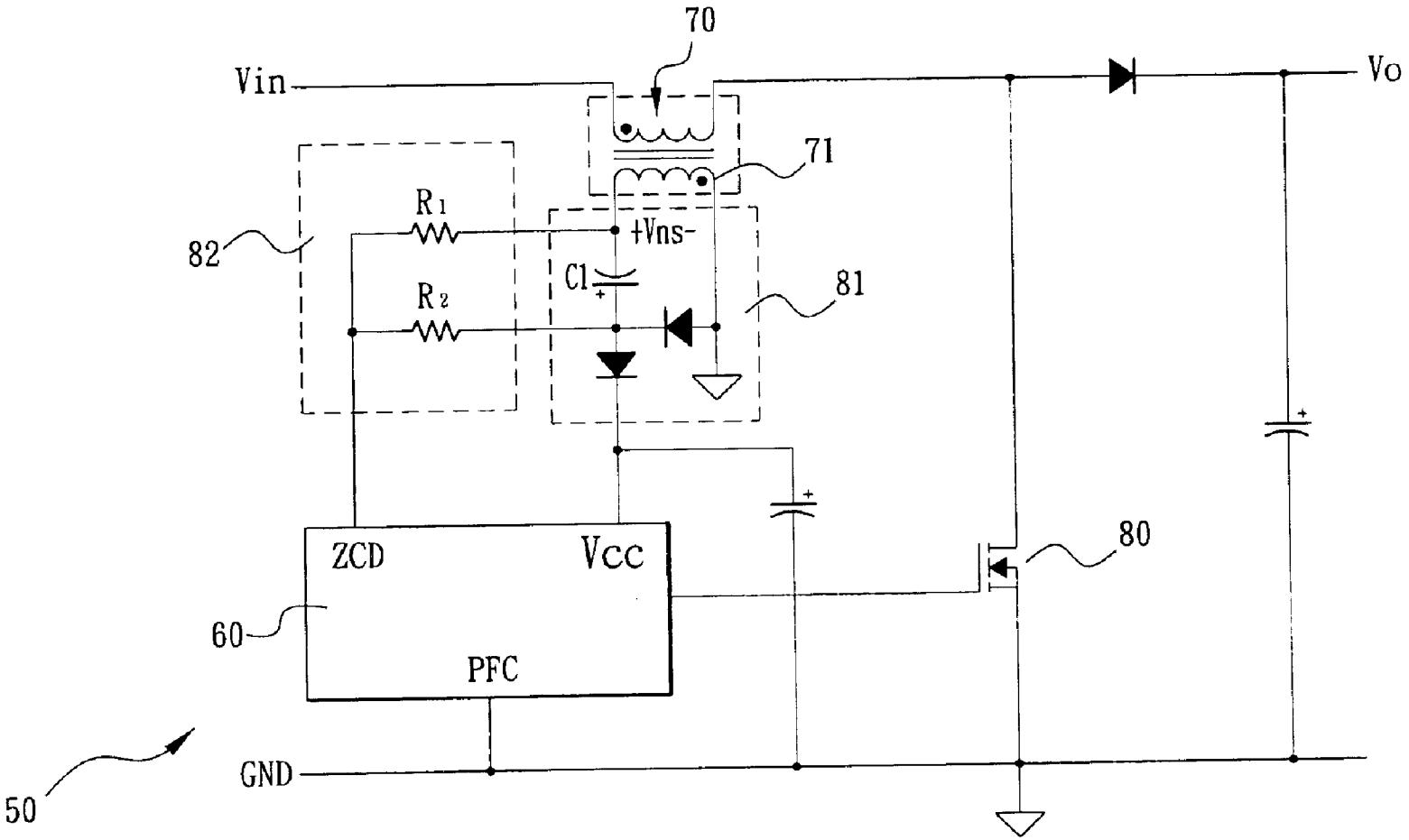
FIG. 9 is a circuit diagram of the control circuit of the invention incorporating resistors $R_1$ and $R_2$.
Figure 10:
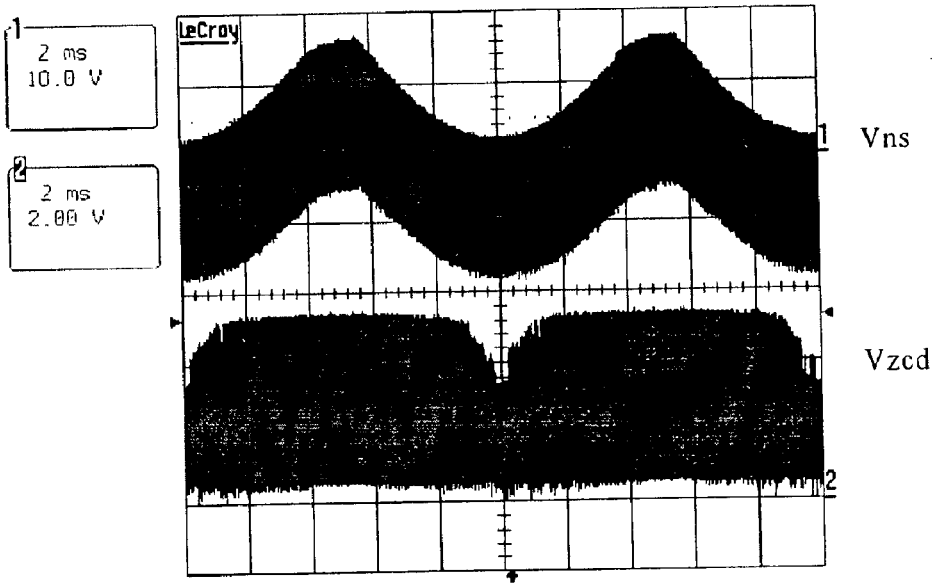
FIG. 10 is a waveform of voltage detected at ZCD pin ZCD in the control circuit of FIG. 9.

For solving the problem, as referring to FIG. 9 a solution is proposed by the invention by connecting a resistor $R_1$ in series with the negative terminal Vcap(−) of the rectification filter capacitor C1 which is in turn coupled to the ZCD pin ZCD of the PFC 60. Also, the negative terminal Vcap(−) of the rectification filter capacitor C1 is electrically coupled to the secondary winding 71. The resistors $R_1$ and $R_2$ form a ZCD circuit 82. At this time, terminal voltage of the ZCD pin ZCD of the PFC 60 is not limited by the equation (1) because it is limited by its internal clamping circuit and without being affected by the amplitude of rated 60 HZ. As a result, the secondary winding 71 can be shared by both the ZCD pin ZCD and the power supply pin Vcc of the PFC 60 via the ZCD circuit 82 and the power supply circuit 81 respectively. A test waveform of the result is shown in FIG. 10. A combination of the resistor $R_1$ and a stray capacitance at its one end will cause a time delay. Preferably, a resistance of the resistor $R_1$ is as small as possible as long as a minimum resistance thereof does not cause a current passing through (i.e., either entering or leaving) the ZCD pin ZCD to exceed $^{\pm 3\ mA}$. For example, it does not allow a maximum current to exceed 1.8 mA if a resistance is 10K Ω. Also, in the invention preferably a resistance of the resistor $R_2$ is relatively large since the resistor $R_2$ is served to increase voltage.

Accordingly, the power supply voltage Vcc at the power supply pin Vcc of the PFC 60 can be expressed as follows:

$$Vcc = Vo/n - 2 \times V_F \tag{2}$$

Figure 11:
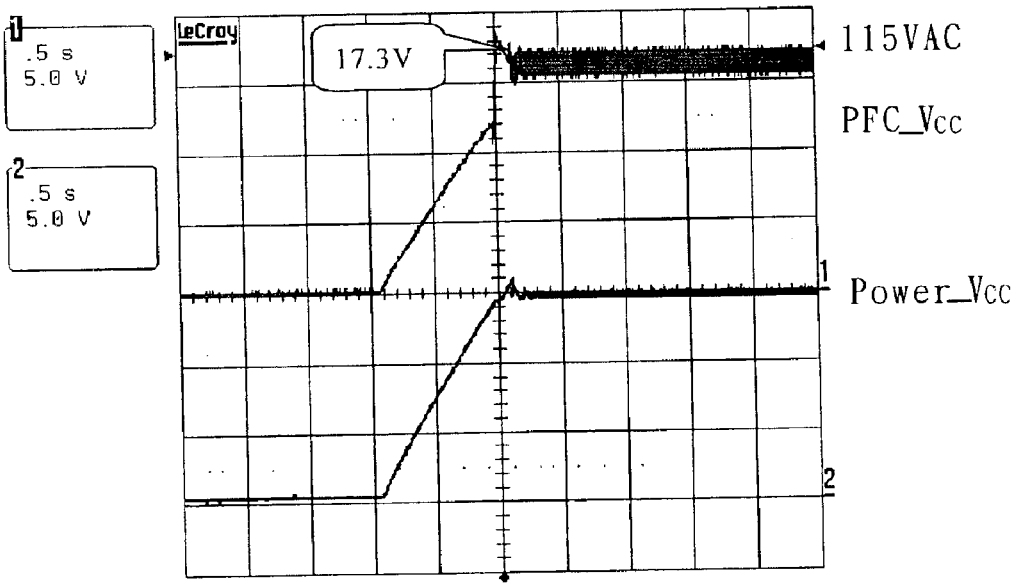
FIG. 11 is a waveform of starting voltage detected at pin Vcc in the control circuit of FIG. 9.

In a case that a Vo equal to 400V, a secondary winding ratio n equal to 22, and a voltage $V_F$ at a secondary winding capacitor C2 equal to 0.4V the Vcc calculated by the equation (2) is 17.4V (i.e., less than 18V). This complies with a specification of the PFC 60. An activation waveform of Vcc is shown in FIG. 11 in which a test value of 17.3V is shown. In the invention, if an over-voltage is occurred at both the ZCD circuit 82 and the power supply circuit 81, an over-voltage may be also occurred at the power supply pin Vcc of the L6561 PFC 60. For preventing this from occurring, a resistor $R_3$ of 10 Ω may be coupled in series with the power supply pin Vcc.

As stated above, the invention as supported by the above experimental data, the secondary winding 71 can be shared by the ZCD pin ZCD and the power supply pin Vcc of the PFC 60 mounted in the switch-based power supply 50 via the resistors $R_1$, $R_2$ of the ZCD circuit 82 and the power supply circuit 81 respectively without a winding ratio limitation, thus eliminating a necessity of providing an additional ZCD winding. By utilizing the invention, it is possible of further reducing the complexity of circuitry, the manufacturing cost, and a size of power supply.

While the invention has been described by means of specific embodiments, numerous modifications and variations could be made thereto by those skilled in the art without departing from the scope and spirit of the invention set forth in the claims.

What is claimed is:

1. An auxiliary circuit for a power factor corrector having self-power supplying and zero current detection mechanisms comprising:

a converter including a primary winding, a secondary winding, and other circuits and components;

a power supply circuit including a filter capacitor electrically coupled to one side of the secondary winding;

a zero current detector (ZCD) circuit including at least two resistors each having one end electrically coupled to positive and negative terminals of the filter capacitor;

a power factor corrector (PFC) including a ZCD pin electrically coupled to the ZCD circuit, a power supply pin electrically coupled to the power supply circuit, and a plurality of other pins electrically coupled to the other circuits and components of the converter; and a toggle latch electrically coupled to one pin of the PFC and the primary winding respectively for switching in response to a trigger signal sent from the pin, wherein the other end of each of the resistors is electrically coupled to the ZCD pin.

2. The auxiliary circuit of claim 1, wherein the PFC is a boundary mode PFC.

3. The auxiliary circuit of claim 1, wherein the negative terminal of the filter capacitor is electrically coupled to the secondary winding and the positive terminal thereof is electrically coupled to the power supply pin via the power supply circuit.

4. The auxiliary circuit of claim 1, wherein a resistance of one resistor electrically coupled to the negative terminal of the filter capacitor is less than that of the other resistor electrically coupled to the positive terminal of the filter capacitor.

* * * * *